US006055950A

United States Patent [19]

Schäfer et al.

[11] Patent Number: 6,055,950

[45] Date of Patent: May 2, 2000

[54] ARRANGEMENT FOR CONTROLLING A DEVICE FOR CHANGING THE VALVE TIMING OF AN INTERNAL COMBUSTION ENGINE

[75] Inventors: Jens Schäfer, Herzogenaurach; Bernd Reuter, Schwaig; Martin Scheidt, Adelsdorf; Dirk Heintzen, Hagen, all of Germany

[73] Assignee: INA Walzlager Schaeffler oHG, Germany

[21] Appl. No.: 09/138,225

[22] Filed: Aug. 21, 1998

[30] Foreign Application Priority Data

Aug. 21, 1997 [DE] Germany ..... 197 36 376

[51] Int. Cl.[7] ..... F01L 1/344

[52] U.S. Cl. ..... 123/90.17; 123/90.31; 74/568 R; 464/2; 464/160

[58] Field of Search ..... 123/90.12, 90.15, 123/90.17, 90.31; 74/568 R; 464/1, 2, 160

[56] References Cited

U.S. PATENT DOCUMENTS 5,520,145 5/1996 Nagai et al. ..... 123/90.17

5,615,648 4/1997 Ruoff et al. ..... 123/90.17

FOREIGN PATENT DOCUMENTS 40 29 849 A1 3/1991 Germany .

41 27 327 A1 2/1993 Germany .

42 27 001 A1 2/1994 Germany .

WO 93 07 362 A1 4/1993 WIPO .

*Primary Examiner*—Weilun Lo

*Attorney, Agent, or Firm*—Volpe and Koenig, P.C.

[57] ABSTRACT

An arrangement for controlling a device for changing the control times of gas exchange valves of an internal combustion engine is provided. The device includes a hydraulic pressure cylinder with an axially movable piston the setting motions of which are transformed into relative rotation of a drive part of the pressure cylinder connected to the crankshaft in relation to a drive part of the pressure cylinder connected to the camshaft. the hydraulic pressure cylinder is subdivided by the piston into two pressure chambers (3, 4), with each being provided with a pressure medium connection (5, 6) to which a hydraulic pump (7) is connected upstream and a pressure medium reservoir (8) is connected downstream, and whose pressure medium inflow or pressure medium outflow is controlled by a hydraulic valve arrangement controlled by a motor controller (9).

2 Claims, 2 Drawing Sheets

ARRANGEMENT FOR CONTROLLING A DEVICE FOR CHANGING THE VALVE TIMING OF AN INTERNAL COMBUSTION ENGINE

BACKGROUND OF THE INVENTION

The invention concerns an arrangement for controlling a device for changing the timing of gas exchange valves of an internal combustion engine, and more particularly for controlling a hydraulic pressure cylinder having a piston which is movable between two end settings for relative rotation of a drive part of the pressure cylinder which is connected to the crankshaft in relation to a drive part of the pressure cylinder which is connected to the camshaft by controlling the hydraulic pressure in the chambers formed in the hydraulic pressure cylinder on each side of the piston.

A similar type of arrangement is previously known from DE-OS 195 05 741. With this arrangement, in order to avoid starting noises with camshaft setting mechanism, the setting mechanism basically consists of a hydraulic pressure cylinder with a piston movable between two end positions whose linear position movements are transformed into relative rotations of a drive part of the pressure cylinder connected with a crankshaft in relation to an output part of the pressure cylinder connected with a camshaft. In this arrangement, the pressure cylinder is subdivided by the piston into two pressure chambers, each having a pressure medium connection, with a hydraulic pump driven by the crank shaft being connected upstream, and a pressure medium reservoir being connected downstream. The inflow and outflow of pressure medium to the pressure chambers and accordingly the piston position required in any given case for the relative rotation between camshaft and crankshaft is controlled by a hydraulic valve arrangement governed by a motor controller which in the specific case is formed by a 4/3 way valve. This 4/3 way valve is installed at the upstream and downstream connections from both pressure chambers such that, in a first switch setting in which the one pressure chamber is connected with the pressure medium reservoir through its pressure medium connection and the other is connected with the hydraulic pump through its pressure medium connection, the piston is moved in the direction of one of its end positions. In a second switch setting of the 4/3 way valve, in which the pressure medium inflow as well as the pressure medium outflow from both chambers is blocked, any desired controlled position of the piston can be set. In a third switch setting of the 4/3 way valve in which the one pressure chamber is connected with the hydraulic pump by its pressure medium connection and the other pressure chamber is connected with the pressure medium reservoir through its pressure medium outflow, movement of the piston takes place in the direction of the other of its end positions.

The proportional valves used in practice for continuous camshaft setting mechanisms constructed as 4/3 way valves have nonetheless turned out to be relatively expensive, since they are outfitted with four control or throttle cross sections whose relationship to one another is established by the shape of the movable spool valve and the housing. Moreover, the position of all four control edges has very narrow tolerance in relation to one another, owing to which very high standards are placed on their manufacturing precision, resulting in high manufacturing costs as well. Above and beyond this, such proportional valves on principle have the disadvantage that they require a magnet with relatively large dimensions to generate a linear characteristic curve between current and the magnetic force of their magnet, or to generate a constant magnetic force at constant current over the stroke in the operating range of the magnet (which must be designed for the maximum required drive force attainable), and consequently requires a relatively large space.

SUMMARY OF THE INVENTION

For this reason, underlying the invention is the objective of designing an arrangement for controlling a device for changing the timing of gas exchange valves of an internal combustion machine with which the previously typical 4/3 way proportional valves are replaceable by more economical hydraulic switching elements which require the same or less space or have more suitable installation conditions.

According to a first embodiment, the objective in connection with an arrangement for controlling a device for changing the valve timing of an internal combustion engine is accomplished in accordance with the invention such that the pressure chambers of the pressure cylinders are permanently connected to the pressure medium supply of the hydraulic pump and the adjustment of the piston position is accomplished by a selective pressure medium outflow from the pressure chambers of the pressure cylinders controlled by a 3/3 way valve connected downstream of the pressure chambers in each case. During this sequential control, movement of the piston in the direction of one of its two end positions takes place in a first switch setting of the 3/3 way valve in which the pressure medium outflow of the one pressure chamber is connected with the pressure medium reservoir and the pressure medium outflow of the other pressure chamber is blocked. In contrast, in a second switch setting of the 3/3 way valve in which the pressure medium outflow of both pressure chambers is blocked, any desired controlled position of the piston can be held since the continuous pressure medium inflow into both pressure chambers with equal compressive force brings about a hydraulic clamping of the piston. In a third switch setting of the 3/3 way valve in which the pressure medium outflow of the one pressure chamber is blocked, and the pressure medium outflow of the other pressure chamber is connected with the pressure medium reservoir, once again an adjustment of the position of the piston in the direction of the other of its two end positions takes place.

As an alternative to this, it is also possible as a variant of the invention to arrange two 2/2 way valves, with each being individually connected downstream of one of the pressure chambers, each with a flow through and a blocking position instead of the 3/3 way valve. The 2/2 way valves are controlled with the same engineering logic as the 3/3 way valve. Besides, it has proven to be especially advantageous with regard to the emergency running position of the camshaft setting mechanism to integrate the 2/2 way valves in terms of circuit engineering such that one 2/2 valve is switched in a current-free state to the flow through position and the other 2/2 way valve is switched in the current-free state to the closed position so that the piston is moved to one of its end positions. It is also possible, however, to maintain the position of the camshaft resetting facility in a regulated emergency running position in which both 2/2 way valves are switched in the current-free state into their closed positions. The preferred choice of current-free switch settings also applies here analogously when using a 3/3 way valve for the arrangement of the invention.

Independently of the use of a 3/3 way valve or a 2/2 way valve, it is furthermore suggested in configuring the first arrangement in accordance with the invention to place a check valve which blocks return flow in the direction of the hydraulic pump on the input end of each of the pressure medium connections of the pressure chambers in order not to drain off the pressure medium flow from the other pressure chamber of the pressure cylinder over the hydraulic pump into the pressure medium reservoir, or to prevent the shifting of the pressure medium volume between pressure chambers. Check valves arranged in this manner have also proven to be advantageous to support the hydraulic clamping of the piston of the camshaft setting mechanism since they close during pressure medium peak pressure resulting from the oscillating torque of the camshaft. The check valves are likewise advantageously suited for compensating for system leakages since they open in the event of low pressure in the pressure chambers of the camshaft setting mechanism and make it possible to suck the pressure medium into the pressure chambers lacking pressure. To attain a "softer" setting behavior of the pressure cylinder piston, or to restrict the consumption of pressure medium, it is further suggested with this arrangement to combine the check valves with transverse baffles which slightly reduce the influx of pressure medium toward the pressure chambers without a nominal negative impact on the rate of displacement of the piston.

According to a second embodiment, the object of the invention in connection with an arrangement for controlling a device for changing the valve timing of an internal combustion engine is in contrast accomplished in accordance with the invention such that the adjustment of the cylinder position is controlled by means of a selective pressurization of the pressure chambers of the pressure cylinder by means of a 4/2 way valve connected at the input/output connection of each of the pressure chambers as well as by selective regulation of the pressure medium outflow from the pressure chambers by means of a 2/2 way valve connected in series at the output end of the 4/2 way valve. At the same time, the one pressure chamber is switched completely to the pressure medium supply of the hydraulic pump and the other pressure chamber is completely opened toward the pressure medium reservoir in a first switch setting of the 4/2 way valve and in a first switch setting of the 2/2 way valve so that the pressure cylinder piston is moved with the maximum rate of displacement in the direction of the one of its two end positions. In the second possible switch setting of the 4/2 way valve, a reversal of the pressurization of the pressure chambers occurs while retaining the first switch setting of the 2/2 way valve so that the piston of the pressure cylinder is moved once again with maximal displacement speed in the direction of the other of its two end positions. Should a desired controlled position of the piston be set, the second possible valve setting of the 2/2 way valve is selected for the downstream connection of either the first or second valve settings of the 4/2 way valve so that the one pressure chamber is again connected completely to the pressure medium supply, and the other pressure chamber is, however, opened throttled to the pressure medium reservoir or the reverse. If the piston of the pressure cylinder then runs out of the controlled position specified by the motor controller due to the throttled pressure medium outflow from one of the two pressure chambers, a transfer of the switch setting of the 4/2 way valve, and therewith a reversal of the throttled pressure medium flow from the pressure chambers takes place so that the piston once again moves in the opposite direction. Owing to a correspondingly rapid changing of the switch settings of the 4/2 way valve, an approximately constant controlled position of the pressure cylinder is consequently attainable.

In configuring of the second embodiment of the invention, it is moreover proposed that yet a second 2/2 way valve of like kind be connected in series on the output end of the 2/2 way valve with which, in a first switch setting, the whole or throttled pressure medium outflow of the first 2/2 way valve is completely feedable to the pressure medium reservoir, and in a second valve setting, the complete or throttled pressure medium outflow of the first 2/2 way valve is once again feedable to the pressure medium reservoir. It is possible through this second 2/2 way valve to tune the switching thresholds of the 4/2 way valve for controlling the piston position more finely so that the relatively hard setting movements of the piston can be compensated with only a 2/2 way valve with the second 2/2 valve when motion is reversed. The additional expense necessary for this tuning of the motor management is compensated for by a lesser expenditure in connection with programming with regard to temperature and operating voltage drift.

In relation to possible emergency running properties of the camshaft setting mechanism in the event of energy loss or the like, it has also proven advantageous with this embodiment of the arrangement of the invention to integrate the 2/2 valves into the arrangement such that they are completely open toward the pressure medium reservoir in the current-free state so that the piston of the pressure cylinder reassumes one of its two end positions. Should a certain end position of the piston be is intended, for example an end position bringing about an "early" opening of the gas exchange valves, the switch setting of the 4/2 way valve in the current-free state should be correspondingly integrated into the arrangement.

The objective of the invention in connection with an arrangement for controlling a device for changing the valve timing of an internal combustion engine is accomplished in accordance with a third embodiment of the invention such that the adjustment of the piston position of the pressure cylinder is controlled by selectively pressurizing the pressure chambers of the pressure cylinder by means of two 3/2 way valves, with each being individually connected at the input/output connection of the pressure chambers. These 3/2 way valves have an unthrottled and a blocked through flow as one switching possibility, as well as a throttled and a blocked through flow as another switching possibility, and are directly connected upstream of the pressure chambers of the pressure cylinders such that in a first switch setting of the first 3/2 way valve and in a first switch setting of the second 3/2 way valve in which the one pressure chamber is completely connected to the pressure medium supply of the hydraulic pump and the other pressure chamber is opened throttled toward the pressure medium reservoir they bring about a displacement of the pressure cylinder piston in the direction of one of its two end positions. In contrast, in a second switch setting of the first 3/2 way valve and in a second switch setting of the second 3/2 way valve, the reversal of the pressurization of the pressure chambers takes place so that the piston of the pressure cylinder is moved in the direction of the other of its two end positions. To adjust to any desired controlled position of the piston of the pressure cylinder, the first 3/2 way valve is moved into its first switch setting and the second 3/2 way valve into its second valve setting through time-shifted or simultaneous control over the motor controller so that both pressure chambers of the pressure cylinder are completely connected to the pressure medium supply of the hydraulic pump and the pressure cylinder piston is hydraulically clamped by a pressure equilibrium in both pressure chambers.

In the event of a loss of energy or the like, the integration of 3/2 way valves has a current-free emergency running position in connection with this embodiment of the arrangement of the invention such that one 3/2 way valve is wholly connected to the pressure medium supply of the hydraulic pump and that the other 3/2 way is open throttled toward the pressure medium reservoir so that the piston of the pressure cylinder reassumes one of its two end positions. Which of the two 3/2 way valves here is opened toward the pressure medium supply or toward the pressure medium reservoir again depends upon whether a displacement of the piston into an "early" or "late" end position is desired.

According to a fourth embodiment, the objective of the invention in connection with an arrangement for control of a device for changing the valve timing of an internal combustion engine in accordance with the invention is finally additionally accomplished such that the pressure chambers of the cylinder, as with the first embodiment, are permanently connected to the pressure medium feed of the hydraulic pump, and adjusting the piston position of the pressure cylinder is controlled by a selective pressure medium outflow from the pressure chambers of the pressure cylinders by means of a 3/2 way valve in each case connected downstream and a 2/2 way valve connected to downstream from the 3/2 way valve. With this arrangement likewise constructed as a sequence control, movement of the piston in the direction of one of its two end settings takes place with maximum speed in a first switch setting of the 3/2 way valve and in a first switch setting of the 2/2 way valve in which the pressure medium outflow of the one pressure chamber is connected with the pressure medium reservoir and the pressure medium outflow of the other pressure chamber is blocked. In the second possible switch setting of the 3/2 way valve, the pressure medium outflow of the one pressure chamber is blocked and the pressure medium outflow of the other pressure chamber is opened toward the pressure medium reservoir so that the piston of the pressure cylinder is moved with maximum adjustment speed in the direction of the other of its two end positions for a reversal of motion. Should on the other hand any desired controlled position of the piston be required, the 2/2 way valve is moved into its second switch setting, permitting only a throttled pressure medium outflow toward the pressure medium reservoir, while the 3/2 way valve is switched back and forth alternating between its first and second switch setting so that either the pressure medium outflow of the one pressure chamber is throttled and that of the other pressure chamber is blocked, or vice versa. The transfer of the 3/2 way valve from its first to its second switch setting and the reverse always takes place when the piston of the pressure cylinder "runs out" of the controlled position specified by the motor controller due to the throttled pressure medium outflow so that the reversal of the throttled pressure medium outflow from the pressure chambers brings about a motion of the piston in the opposite direction. A correspondingly rapid change of the switch settings of the 3/2 valves guarantees a nearly constant controlled position of the pressure cylinder piston.

In a further configuration of this embodiment of the invention, it is also suggested that a check valve which blocks in the direction of the hydraulic pump be connected upstream of the chambers in order (just as with the first embodiment of the arrangement of the invention) to avoid pressure medium outflow over the hydraulic pump on the one hand, and pressure peaks and system leakages of the hydraulic pressure medium on the other hand.

For the current-free emergency running position of the control valves used with this embodiment of the invention, the unthrottled switch setting of the 2/2 way valve in connection with one of the two switch settings of the 3/2 way valve has proven to be effective so that the pressure cylinder piston reassumes one of its two end settings. The current-free switch setting of the 3/2 valve is likewise dependent upon the desired end position of the pressure cylinder piston bringing about an "early" or a "later" opening of the gas exchange valves.

All four embodiments of the invention for control of a device for changing the control timing of gas exchange valves of an internal combustion engine provided consequently have in comparison with the previously known 4/3 way proportional valves the advantage that, with simpler and therefore more economical hydraulic switch elements, the control of the piston position in the device is possible in the same way as with the 4/3 way proportional valves. If moreover commercially available hydraulic on-off control valves are relied upon, in most cases an advantage with respect to the smaller space needed or with respect to favorable installation conditions for the control valves are also additionally attainable. The use of these arrangements is not restricted only to camshaft setting mechanisms with axially movable pistons here, but are also suited for camshaft setting mechanisms according to the vane cell principle.

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
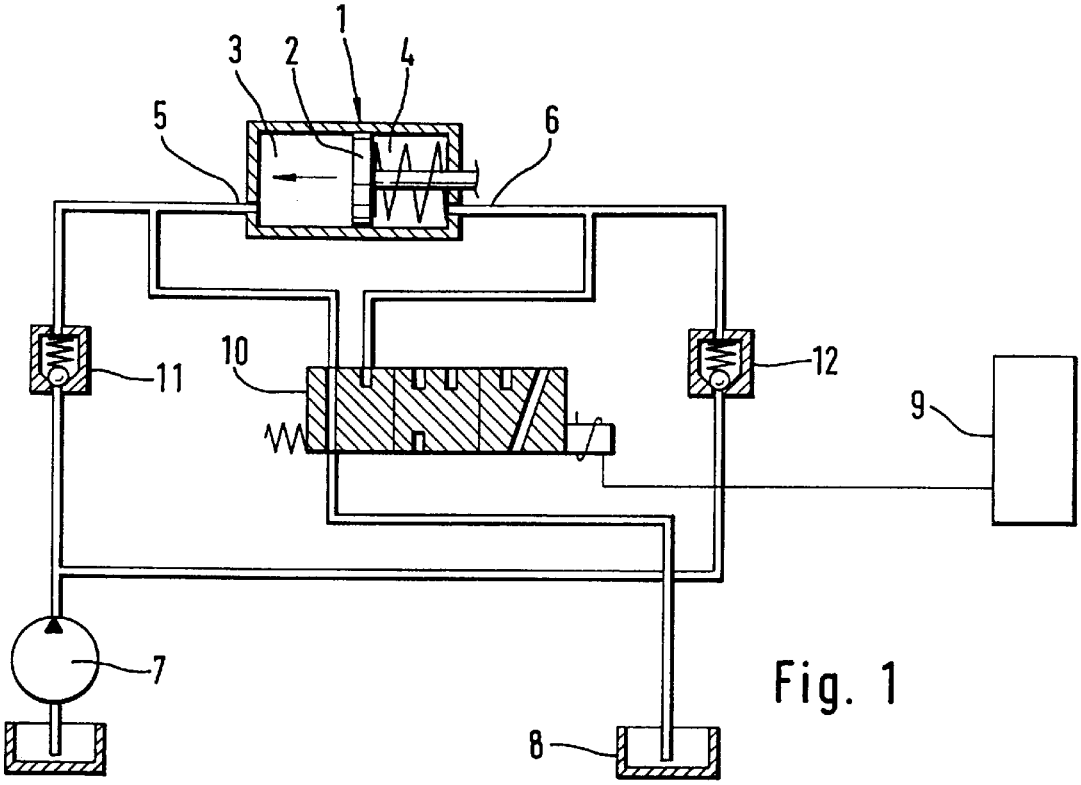
FIG. 1 is a hydraulic circuit diagram of a first embodiment of the control arrangement of the invention.

In each case, an arrangement for controlling a device for changing the control timing of gas exchange valves of an internal combustion motor is shown in FIGS. 1 to 4. The device, which is also known as camshaft setting mechanism, is for all of the cases shown represented schematically as a hydraulic pressure cylinder 1 with a piston 2 movable between two end settings, whose linear displacement motions are transformed into relative rotations of a drive part of the pressure cylinder 1 connected to a crankshaft (not represented) in relation to a drive part of the pressure cylinder 1 connected with a likewise not represented camshaft. This hydraulic pressure cylinder 1 is subdivided by the piston 2 into two pressure chambers 3, 4. Each pressure chamber 3, 4 is provided with a pressure medium connection 5, 6 to which a hydraulic pump 7 driven by the crankshaft is connected in the upstream direction and to which a pressure medium reservoir 8 is connected in a downstream direction. The pressure medium inflow or outflow of the pressure chambers 3, 4 and therewith the position of the piston 2 of the pressure cylinder 1 necessary in any given case for the relative rotation between camshaft and crankshaft is controlled by a hydraulic valve arrangement regulated by a motor controller 9 in a known manner.

According to the embodiment of the arrangement for controlling a camshaft setting mechanism shown in FIG. 1, the adjustment of the piston position of the pressure cylinder 1 is realized according to the invention such that the pressure chambers 3, 4 of the pressure cylinder 1 are permanently connected to the pressure medium supply of the hydraulic pump while a 3/3 way valve 10 is connected in each case downstream from the pressure chambers 3, 4 which exclusively controls the pressure medium outflow from the pressure chambers 3, 4. Here a movement of the piston 2 in the direction of its one end position indicated by an arrow takes place in a first switch setting, as shown in FIG. 1, in which the pressure medium outflow of the one pressure chamber 3 is connected with the pressure medium reservoir 8 and the pressure medium outflow of the other pressure chamber 4 is blocked, since a higher pressure medium pressure is built up in the other pressure chamber 4 than in the one pressure chamber 3. In a second switch setting of the 3/3 way valve 10, corresponding to the middle switch setting, the pressure medium outflow of both pressure chambers 3, 4 is blocked, and any desired controlled position of the piston 2 can be adjusted and maintained hydraulically. Should it be desired to move the piston 2 in the direction opposite to the direction arrow in FIG. 1, the pressure medium outflow of the one pressure chamber 3 is blocked and the pressure medium outflow of the other pressure chamber 4 is connected with the pressure medium reservoir 8 in a third switch setting of the 3/3 way valve 10 so that in this case a higher pressure medium pressure builds up in the one pressure chamber 3 than in the other pressure chamber 4. In order to avoid a pressure medium outflow over the hydraulic pump 7 while adjusting the position of the piston 2 in the directions of its end positions, a check valve 11, 12 is connected upstream from the pressure medium connections 5, 6.

Figure 2:
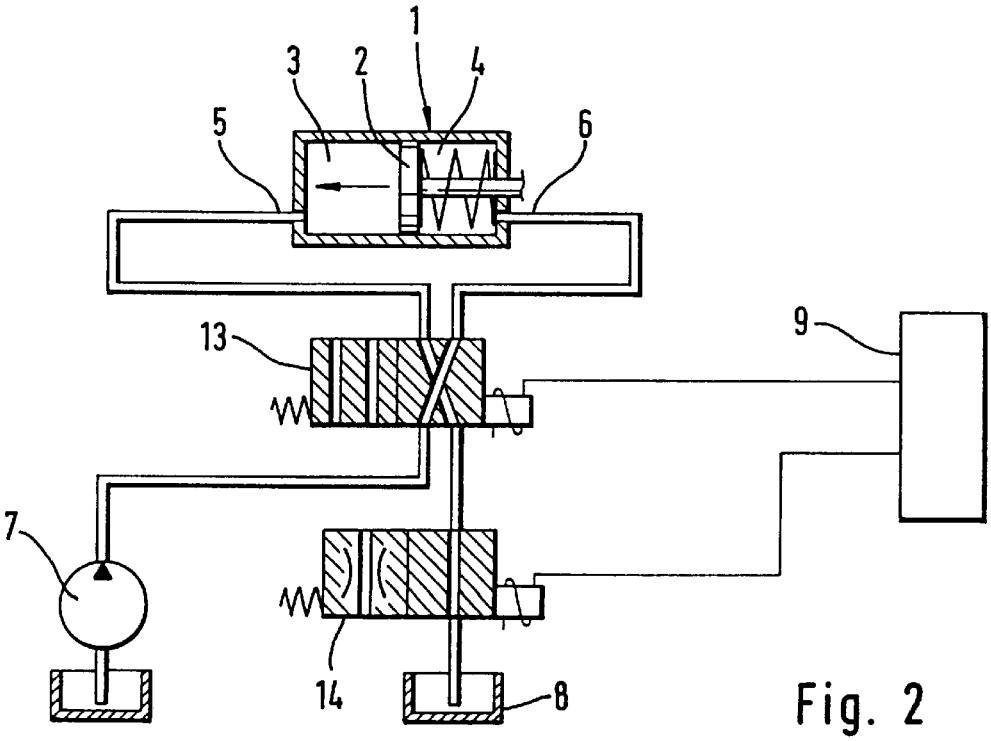
FIG. 2 is a hydraulic circuit diagram of a second embodiment of the control arrangement of the invention.

A second embodiment of the arrangement for control of a camshaft setting mechanism is shown in FIG. 2. The adjustment of the piston position in the pressure cylinders in contrast take place in accordance with the invention in the manner that a selective pressurization upon the pressure chambers 3, 4 as well as a selective regulation of pressure medium outflow from the pressure chambers 3, 4 are regulated by means of a 4/2 way valve 13 connected to control the upstream and downstream flow to and from the pressure chambers 3, 4, as well as a 2/2 way valve 14 connected in series at the downstream side of the 4/2 way valve. Here once again a movement of the piston 2 in the direction of one end position takes place in a first switch setting, corresponding to the representation in FIG. 2, in which the one pressure chamber 4 of the pressure cylinder 1 is completely connected to the pressure medium supply of the hydraulic pump 7 and the other pressure chamber 3 is completely opened toward the pressure medium reservoir 8. A switching controlled by the motor controller 9 of the second switch setting of the 4/2 way valve 13 brings about a reversal of the pressurization of the pressure chambers 3, 4 while retaining the first switch setting of the 2/2 way valve, and consequently a movement of the piston 2 in the direction of its other end position, opposite to the arrow direction in FIG. 2. If during the movement of the piston 2 in the directions of its end positions the 2/2 way valve 14 is switched into its second valve setting so that one pressure chamber 3 or 4 is always connected to the pressure medium supply of the hydraulic pump 7, and one pressure chamber 3 or 4 is open throttled toward the pressure medium reservoir 8, any desired controlled position of the piston 2 can be adjusted in the pressure cylinder 1 by switching back and forth between the first and second switch settings of the 4/2 way valve 13 regulated by the motor controller 9.

Figure 3:
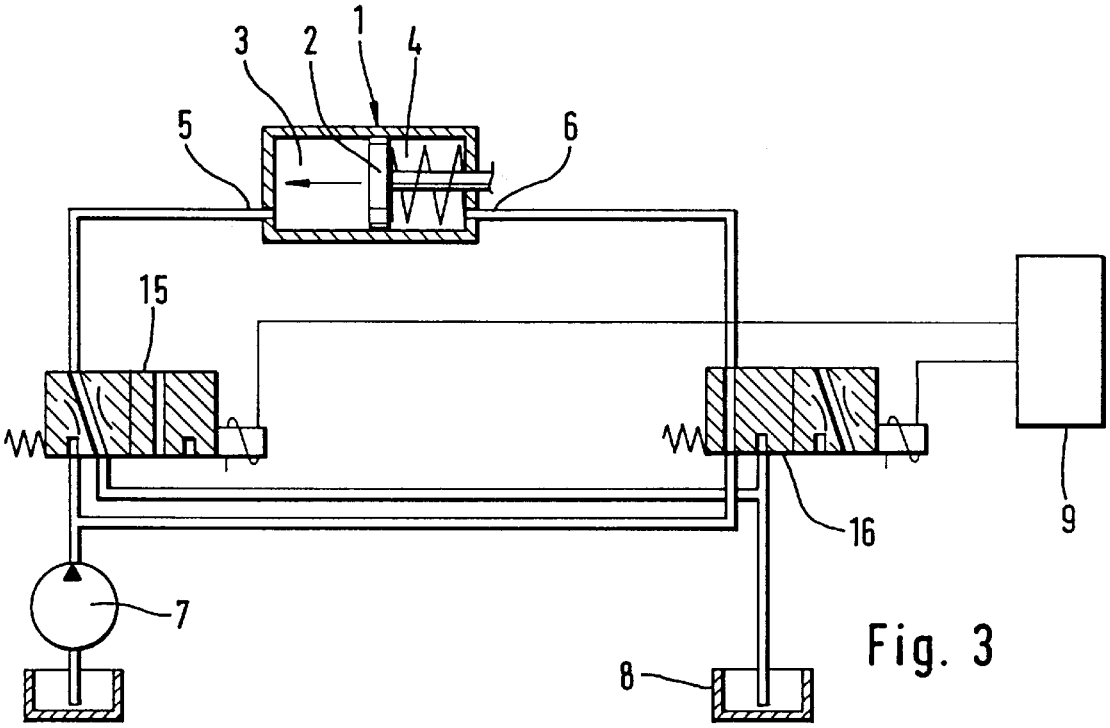
FIG. 3 is a hydraulic circuit diagram of a third embodiment of the control arrangement of the invention.

With the third embodiment of the arrangement for controlling a camshaft setting mechanism shown in FIG. 3, an adjustment of the piston position of the pressure cylinder 1 is also possible in accordance with the invention using a selective pressurization of pressure chambers 3, 4 controlled by two 3/2 way valves 15, 16, which in each case are individually connected parallel at the input and output ends of the pressure chambers 3, 4. With this arrangement, the piston 2 of the pressure cylinder 1 is moved in the direction of its one end setting, indicated by the arrow, in a first switch setting of the first 3/2 way valve 15, as shown in FIG. 3, and in a first switch setting of the second 3/2 way valve 16, also shown in FIG. 3, in which the one pressure chamber 4 is completely connected with the pressure medium supply of the hydraulic pump 7 and the other pressure chamber 3 is opened throttled toward the pressure medium reservoir 8. If both 3/2 way valves 15, 16 are then simultaneously reset by the motor controller 9 to their second switch position, a reversal of the pressurization of pressure chambers 3, 4 takes place, and the piston 2 of the pressure cylinder 1 is moved in the direction toward its other end position, opposite to the direction arrow in FIG. 3. In a third switch combination in connection with which the first 3/2 way valve 15 retains its second switch setting and the second 3/2 way valve 16 is changed back to the first switch setting by time-shifted or simultaneous control by the motor controller 9, both pressure chambers 3, 4 are completely connected to the pressure medium supply of the hydraulic pump 7 so that the piston 2 of the pressure cylinder 1 is held in any desired controlled position by hydraulic clamping. The fourth possible switch combination, namely the first switch setting of the first 3/2 way valve 15 together with the second switch setting of the second 3/2 way valve 16, in which both pressure chambers 3, 4 are opened throttled toward the pressure medium reservoir 8, is eliminated by the motor controller 9.

Figure 4:
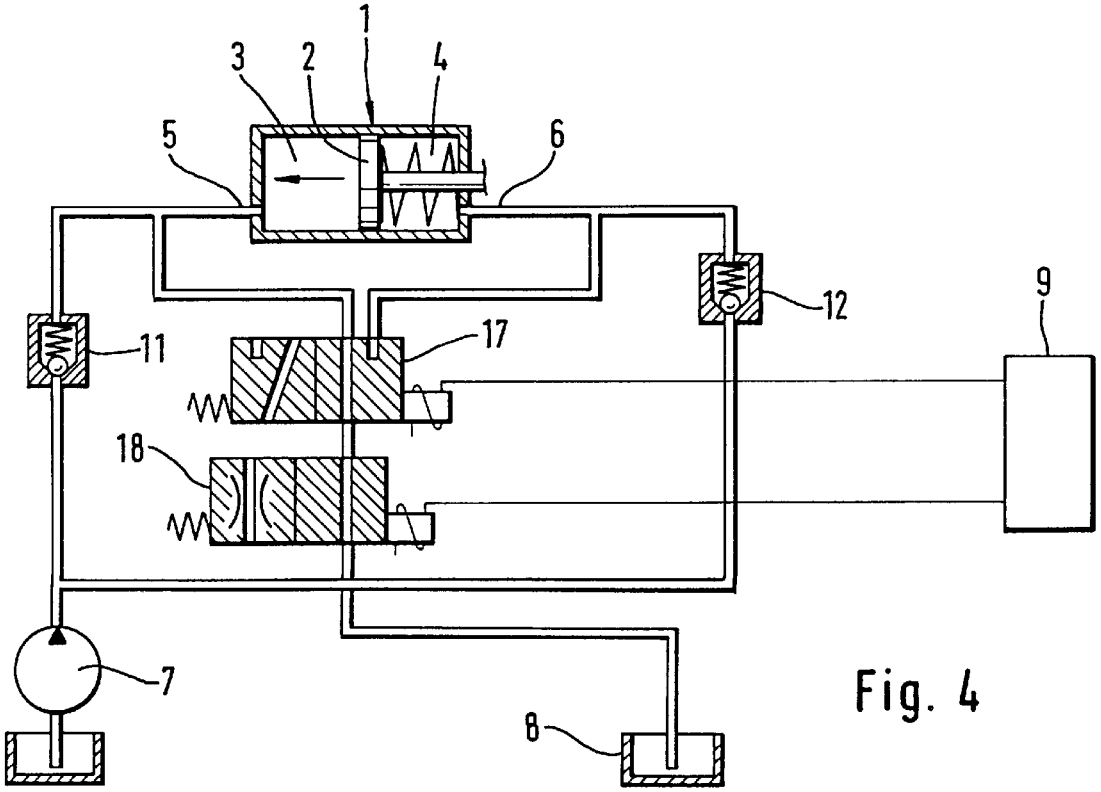
FIG. 4 is a hydraulic circuit diagram of a fourth embodiment of the control arrangement of the invention.

The fourth embodiment of the arrangement for control of a camshaft setting mechanism shown in FIG. 4 represents a further possibility of the invention, following from the first embodiment represented in FIG. 1, for controlling the adjustment of the piston position of the pressure cylinder 1 by a selective pressure medium outflow out of the pressure chambers 3, 4 of the pressure cylinder 1. A 3/2 way valve 17 is connected downstream the pressure chambers 3, 4, and a further 2/2 way valve 18 is connected at the output end of the first 3/2 way valve 17. Here, movement of the piston 2 in the direction of its one end position, indicated by an arrow in FIG. 4, takes place in a first switch setting of the 3/2 valve 17, as shown in FIG. 4, and in a first switch setting of the 2/2 way valve 18, also shown in FIG. 4, in which the pressure medium outflow of the one pressure chamber 3 is connected with the pressure medium reservoir 8 and the pressure medium outflow of the other pressure chamber 4 is blocked. This results in a higher pressure medium pressure build up in the other pressure chamber 4 than in the one pressure chamber 3. While retaining the same first switch setting of the 2/2 way valve 18, the piston 2 is moved in the opposite direction toward its other end position, opposite to the direction arrow in FIG. 4, by selecting the second possible switch setting of the 3/2 way valve 17 in which the pressure medium outflow of the one pressure chamber 3 is blocked and the pressure medium outflow of the other pressure chamber 4 is connected with the pressure medium reservoir

8. This causes a higher pressure medium pressure build up in the one pressure chamber 3 than in the other pressure chamber 4. In the first switch setting of the 3/2 way valve 17 and in a second switch setting of the 2/2 way valve 18, in which the pressure medium outflow of the one pressure chamber 3 is connected throttled with the pressure medium reservoir 8 and the pressure medium outflow of the other pressure chamber 4 is blocked again, or in the second switch setting of the 3/2 way valve 17 and in a second switch setting of the 2/2 way valve 18, in which the reversal of the throttled pressure medium outflow from the pressure chambers 3, 4 takes place, any desired controlled position of the piston 2 can also be adjusted and hydraulically maintained by a switching back and forth of the first and second switch setting of the 3/2 way valve 17 regulated by the motor controller 9.

What is claimed is:

1. A control arrangement for controlling a device for altering control timing of gas exchange valves of an internal combustion engine, the device including a hydraulic pressure cylinder (1) with a piston (2) movable between two end settings with the movement being transformed into relative rotation of a drive part of the pressure cylinder (1) adapted for connection with a crankshaft in relation to a driven part of the pressure cylinder (1) adapted for connection with a camshaft, the hydraulic pressure cylinder (1) being subdivided by the piston (2) into two pressure chambers (3, 4), each being provided with a pressure medium connection (5, 6), with a hydraulic pump (7) having a pressure medium supply being connected upstream and a pressure medium reservoir (8) being connected downstream, pressure medium inflow and pressure medium outflow from the two pressure chambers being controlled by a hydraulic valve arrangement regulated by a motor controller (9), wherein the improvement comprises:

the pressure chambers (3, 4) of the pressure cylinder (1) being permanently connected to the pressure medium supply of the hydraulic pump (7); and a 3/3 way valve (10) being connected to the pressure medium connections downstream from the pressure chambers (3, 4), the 3/3 way valve having three switch positions for controlling flow therethrough and being settable from a first switch setting of the 3/3 way valve, in which the pressure medium outflow of the one pressure chamber (3) is connected with the pressure medium reservoir (8) and the pressure medium outflow of the other pressure chamber (4) is blocked such that the piston (2) moves in a direction of a first one of the two end settings, to a second switch setting, in which the pressure medium outflow of both pressure chambers (3, 4) is blocked such that a desired position of the piston (2) is hydraulically maintained, to a third switch setting, in which the pressure medium outflow of the one pressure chamber (3) is blocked and the pressure medium outflow of the other pressure chamber (4) is connected with the pressure medium reservoir (8) such that the piston (2) moves in a direction of the other of the two end settings, whereby adjustment of the piston position of the pressure cylinder (1) is controlled by a selective pressure medium outflow from the pressure chambers (3, 4) of the pressure cylinder (1).

2. The arrangement according to claim 1, wherein a check valve (11, 12) which restricts flow in a direction of the hydraulic pump (7) is connected upstream of the pressure chamber (3, 4) pressure medium connections (5, 6).

* * * * *